United States Patent [19]

Greeson, Jr.

[11] 3,969,651

[45] July 13, 1976

[54] DISPLAY SYSTEM

[75] Inventor: James C. Greeson, Jr., Woodstock, N.Y.

[73] Assignee: IBM Corporation, Armonk, N.Y.

[22] Filed: Dec. 30, 1974

[21] Appl. No.: 537,818

[52] U.S. Cl. ..... 315/169 TV; 313/188; 313/217

[51] Int. Cl.[2] ..... H05B 41/00

[58] Field of Search ..... 315/169 TV, 169 R; 340/324 M; 313/201, 188, 217, 220

[56] References Cited

UNITED STATES PATENTS

| | | | |
|---|---|---|---|
| 3,042,823 | 7/1962 | Willard | 315/169 TV |
| 3,845,243 | 10/1974 | Schmersal et al. | 315/169 TV X |
| 3,846,656 | 1/1974 | Schermerhorn | 313/217 X |
| 3,886,404 | 5/1975 | Kurahashi et al. | 315/169 TV |

*Primary Examiner*—James B. Mullins
*Attorney, Agent, or Firm*—W. S. Robertson

[57] ABSTRACT

A plasma display panel has twin X and twin Y orthogonal drive lines in place of the single X and single Y drive lines of prior art panels. Each pair of twin drive lines are in close proximity and spaced a relatively much greater distance from the next pair. The dielectric layer covering the drive lines is sufficiently thick to cause the voltage potentials on the twin drive lines to image as one potential on the surface of the dielectric. Each one of the twin drive lines is connected to a selection line such that the raising of any two X selection lines and two Y selection lines produces a write-erase potential on a particular gas cell.

1 Claim, 8 Drawing Figures

FIG. 1
(PRIOR ART)
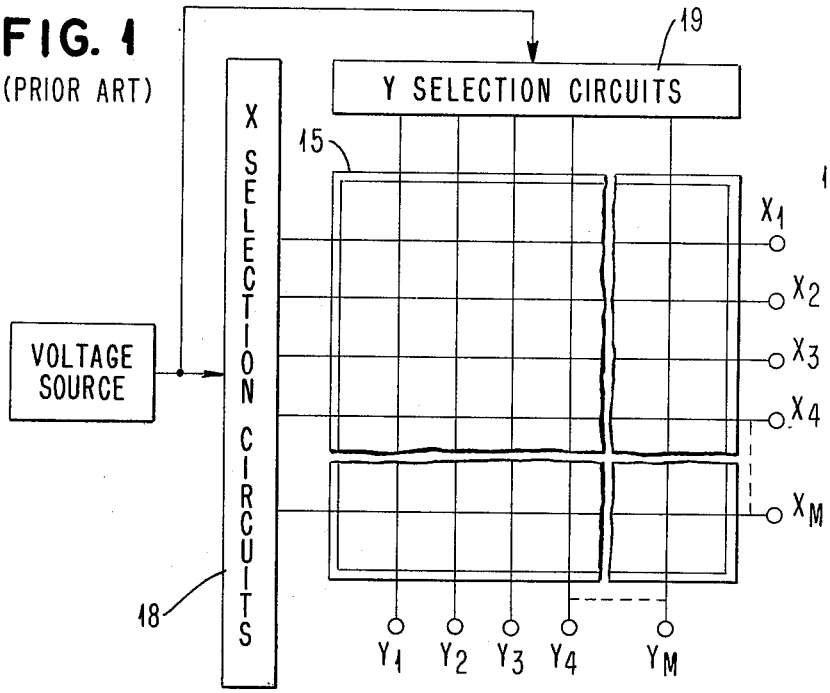
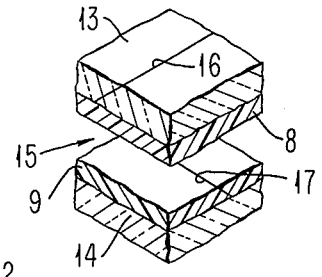
FIG. 2
FIG. 3
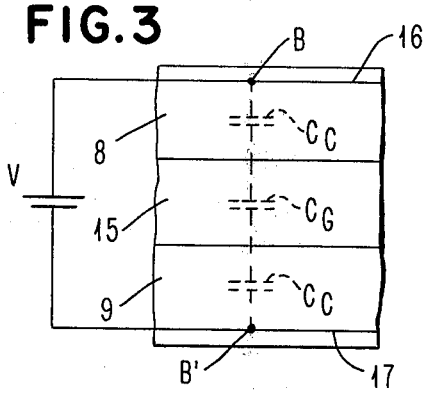
FIG. 4
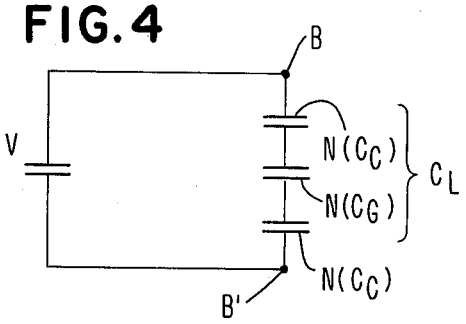
FIG. 5
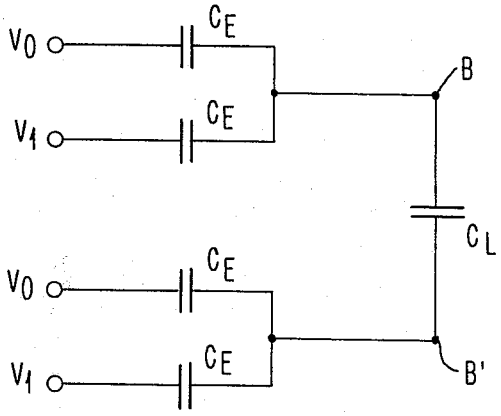

DISPLAY SYSTEM

This invention relates to display devices and more particularly to gas panel display devices.

RELATED PATENTS

This patent application is an improvement to the display system disclosed in U.S. Pat. No. 3,597,758, assigned to the assignee of the present invention, which patent is incorporated herein by reference.

BACKGROUND OF THE INVENTION

Gas display panels of the type to which this invention relates have two flat glass plates that are spaced apart and sealed to contain an ionizable medium. A set of horizontally extending insulated condutors (X drive lines) are located on one glass plate, and a set of vertically extending conductors (Y drive lines) are located on the other plate. These conductors are insulated by a dielectric layer. When a suitable voltage is applied between one horizontal conductor and one vertical conductor, ionization occurs in a region at the cross over point of the two conductors and light is emitted. The cross over points and ionized regions inbetween are called cells, and a display pattern is formed by ionizing selected cells. However, upon application of the firing voltage the cell ionizes and emits light only briefly as free charges formed by the ionization migrate to the insulating dielectric walls of the cell where these charges produce an opposing voltage to the applied voltage and thereby extinguish the ionization. The operation of initially ionizing a cell is called writing. Once a cell has been written a continuous sequence of light flashes can be produced by an alternating voltage called a "sustain" voltage. The amplitude of the sustain waveform can be made less than the amplitude required for the firing voltage, because the wall charges that remain from the preceding write or sustain operation produce a voltage that adds to the voltage of the sustain waveform to produce the ionizing voltage. A previously unwritten (or erased) cell is not ionized by the sustain waveform. In a gas panel of this type the sustain waveform is applied across all the horizontal conductors and all of the vertical conductors so that the gas panel maintains a previously written pattern of light emitting cells.

For a conventional write operation a suitable write voltage pulse is added to the sustain voltage waveform so that the combination of the write pulse and the sustain pulse produces ionization. In order to write an individual cell independently, each of the horizontal and vertical conductors has an individual selection circuit. Thus, applying a sustain waveform across all of the horizontal and vertical conductors but applying a write pulse across only one horizontal conductor and one vertical conductor will produce a write operation in only the one cell at the intersection of the selected horizontal and vertical conductors. An erase operation can be thought of as a write operation that proceeds only far enough to allow the previously charged cell walls to discharge; it is closely similar to the write operation except for timing and amplitude, and the circuits that produce both the write or erase pulses are called "write-erase circuits" or "selection circuits."

The selection circuit usually comprises a transistor switch for each horizontal conductor and each vertical conductor. The horizontal and vertical selection circuits may connect the associated conductors to the horizontal or vertical sustain waveform and to a selected one of the two voltage levels of a write-erase pulse.

In constructing a plasma display panel it is desirable to provide as many vertical and horizontal drive lines per linear inch as practicable. The resolution increases as the number of drive lines per linear inch increases. It is desirable to have high resolution since this permits characters to be drawn more precisely, thereby improving their definition. However, as the number of drive lines per linear inch is increased to a large number to provide greater resolution, the problem of selecting a given one of the horizontal drive lines or given one of the vertical drive lines becomes increasingly more difficult, particularly in large panels which may have a length of several feet or more. Thus, equipment for selecting and firing the numerous gas cells tends to become bulky and complex, and an ultimate limit is reached concerning the size of the display panel. It is to the objective of increasing resolution, increasing the size of a plasma display panel and at the same time providing selection equipment which is capable of performing the increased selection function without becoming unduly complex that the invention of the incorporated patent was directed. Essentially, the incorporated patent was to an invention which reduced the number of selection lines by a passive network external to the panel consisting of capacitance. The provision of the capacitance in the selection circuitry in that invention provided a means for reducing the number of selection lines, achieving a significant cost reduction and eliminating the difficult problems of connecting a large number of selection lines in a small amount of space to the X and Y drive lines.

As will be explained more fully hereinafter, a gas panel is essentially an analog device which can be represented by a capacitance. The ignition voltage must be capable of driving the panel capacitance and in the invention of the incorporated patent it must also drive the additional selection circuit capacitance external to the panel. To achieve proper operation, the external capacitance should be several times larger than the panel capacitance. Consequently, while the circuit of the incorporated patent worked very well for smaller panels, the load capacitance of large panels becomes so great that the requirements for external capacitance become impractical. Thus, it is an object of the present invention to retain the simplified selection circuitry of the incorporated patent and yet eliminate the need for external capacitance.

SUMMARY OF THE INVENTION

In this invention the capacitance that provides the simplified selection circuits is placed within the panel itself rather than external to it. This is achieved by providing twin X drive lines in place of the single X drive line of all previously known gas panels. Similarly, twin Y drive lines are used in place of each single Y drive line in prior art panels. Each pair of twin X drive lines replacing the single X drive line are closely spaced and similarly the twin Y drive lines are closely spaced. The result is to create two capacitance paths between each X conductor and the surface of the dielectric at each cell location and two capacitance paths between each Y conductor and the surface of the dielectric at each cell location. In that manner the simplified selection circuits of the incorporated patent are retained while the requirement for external capacitance is eliminated.

BRIEF DESCRIPTION OF THE DRAWINGS

The foregoing and other objects, features and advantages of the invention will be apparent from the following detailed description of a preferred embodiment of the invention as illustrated in the accompanying drawings wherein:

FIG. 1 is a top view of a prior art display panel showing the X and Y drive lines and the associated circuits.

FIG. 2 shows a sectional isometric view of the major components a single cell and the conductors therein.

FIG. 3 is a circuit representation of the single cell.

FIG. 4 is a circuit representation of the entire panel.

FIG. 5 is a circuit representation wherein external capacitance is used in a prior art selection matrix.

DETAILED DESCRIPTION

Figure 6:
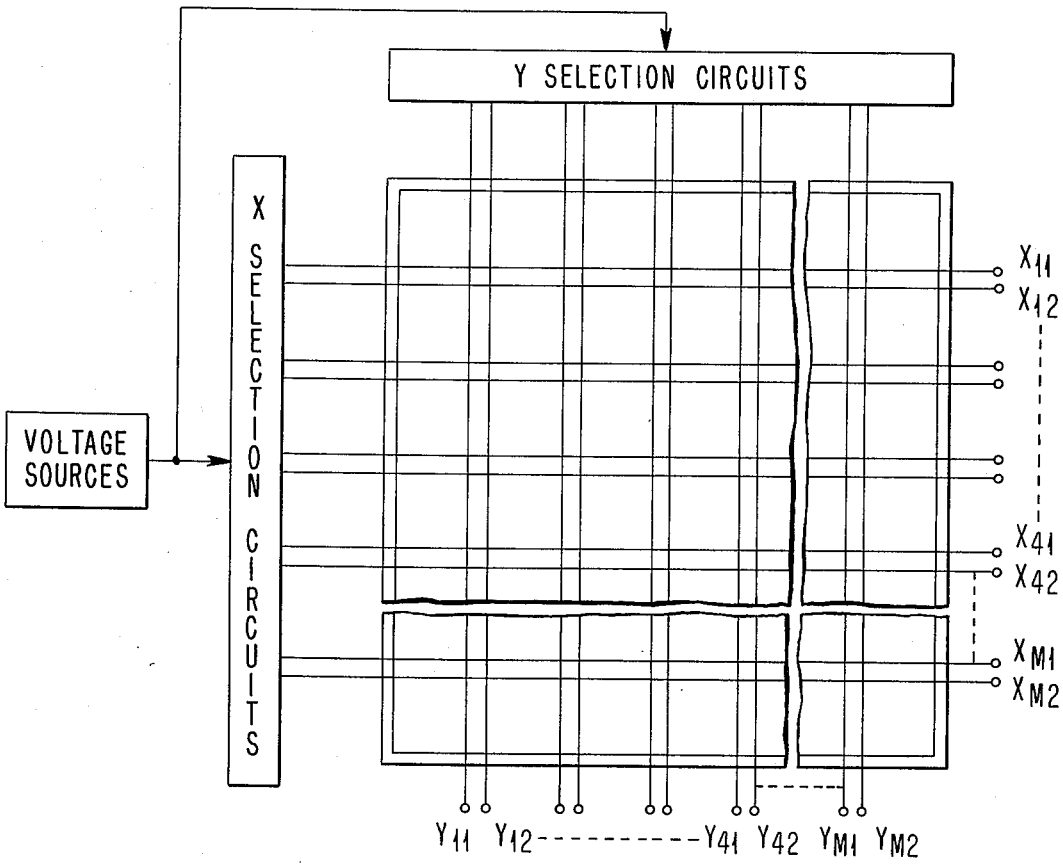
FIG. 6 is a view akin to FIG. 1 showing the twin X and twin Y drive lines of this invention.

Write/erase pulses are applied to each cell in a gas display panel through the X and Y selection circuits of an orthogonal panel. FIG. 1 is a diagram of a typical panel in which the voltage pulses are provided to each of the orthogonal conductors in the panel 12 by the horizontal selection circuits 18 and the vertical selection circuits 19. Ordinarily, each drive line in the panel is associated with a specific selection circuit — one circuit per drive line. However, the invention of the incorporated patent provided a circuit through which the number of selection circuits could be greatly reduced through the use of a capacitive network to "AND" voltages. See FIGS. 1 and 2 thereof.

FIG. 2 shows in perspective the two glass substrate plates 13 and 14 which are the major structural elements of the panel. Two orthogonal conductors 16 and 17 which crossover to form the cell are disposed upon the surface of the glass plates, conductor 16 on glass plate 13 and conductor 17 on glass plate 14. A dielectric layer 8 covers conductor 16 and dielectric layer 9 covers conductor 17. The dielectric layers may be any suitable material; glass or ceramics are commonly used. The space 15 between the two dielectric layers is sealed at the edges of the panel and contains a suitable ionizing gas, such as, neon.

FIG. 3 is an electrical representation of the cell wherein conductors 16 and 17 are shown being driven from a voltage source. The voltage present on conductor 16 is manifested on the surface of dielectric layer 8 and the voltage on conductor 17 is manifested on the surface of dielectric layer 9. The circuit representation providing this manifested voltage is indicated through the coupling capacitance in the dielectric $C_C$. Similarly, these voltages are coupled across the gas space 15 by a capacitance $C_G$ which is shunted by A non-linear voltage dependent current when the cell fires.

In FIG. 4, a circuit similar to FIG. 3 has been shown with the dielectric surfaces removed and a factor of N included to provide a circuit representation of the entire panel where N represents the number of cells in the panel. Note in both FIGS. 3 and 4 the point B which is the point at which the threshold voltage must be supplied to fire the cell. Also note in FIG. 4 that all capacitance interior to the panel has been combined into the term $C_L$.

FIG. 5 is a circuit representation of the panel where the capacitance bus arrangement of the incorporated patent has been utilized to simplify the selection circuitry. Here the external capacitance $C_E$ has been shown for both the X and Y drive lines. It is important to note that point B is no longer directly connected to the voltage source, but it must now be driven through the external capacitance. A circuit analysis shows that the voltage at point B may be represented by the following equation:

$$V_B = \frac{V_0 + V_1}{2 + \frac{C_L}{C}}$$

The desired condition according to the incorporated patent is for the voltage at point B to equal $$\frac{V_0 + V_1}{2},$$

which summation is converted to an "AND" of the applied voltages by the non-linear nature of gas discharge. For that condition to occur, however, it is necessary that the external capacitance be much larger than the internal capacitance. It has been found that a factor of 10 suitably satisfies that condition, and, therefore, the value of the external capacitance is found by the following equation:

$$C_E = \frac{10\ N\ (C_C)}{2}$$

This equation points to the problem involved when the panel size increases since the external capacitance is directly proportional to the number of cells in the panel. Eventually, the size of the panel creates a condition in which the value of the external capacitance becomes impractical.

In order to achieve the simplified selection circuitry of the incorporated patent and yet also to enable its use in large panels, the current invention places the erstwhile external capacitance interior to the panel thus providing a situation in which point B is once again directly driven by the external voltage source. To do that, the individual X drive lines and Y drive lines were each split into two proximate drive lines such that the coupling capacitance to the surface of the dielectric came from two separate lines. By increasing the thickness of the dielectric over prior art panels, the voltages produced by the two separate drive lines appear on the surface of the dielectric as a single voltage and the display operation of the panel is the same as if a single drive line were used.

Figure 7:
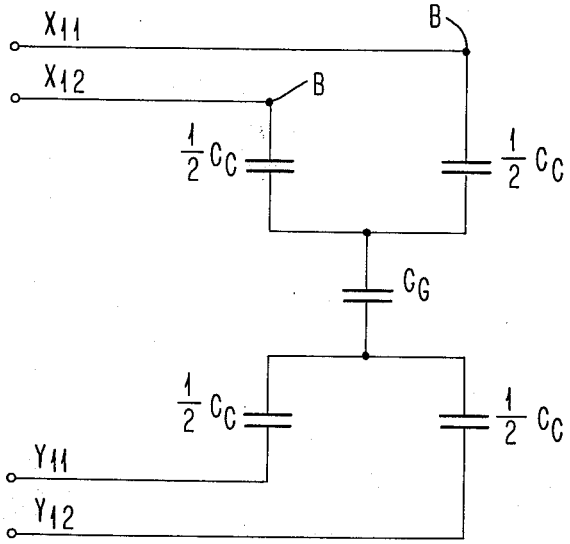
FIG. 7 is a circuit representation of a single cell in the twin X and twin Y panel.

A panel constructed according to the invention is shown in FIG. 6, and the circuit representation of the panel is shown in FIG. 7. The coupling capacitance is approximately one-half that of the prior art panel for each of the twin lines in order to provide a total coupling capacitance equal to prior art panels. In that manner, the image of the separate drive lines is not apparent on the surface of the dielectric. To achieve that condition, as mentioned above, the dielectric must be sufficient thickness; the twin drive lines must be in close proximity and the $X_1$ to $X_2$ spacing must be much greater than the spacing between the twin conductors. Representative spacing is 25 microns between twins and approximately 50 microns between non-twins, and 50 microns thickness for the dielectric.

Note in FIG. 7 that point B is theoretically directly connected to the voltage sources as in FIG. 3, where simplified selection circuitry is not used. Actually there is a leakage capacitance between $X_{11}$ and $X_{12}$ and another leakage capacitance between $Y_{11}$ and $Y_{12}$, and, therefore, point B is not directly connected to the voltage sources. This long line leakage capacitance places a practical limit on the size of the panel using this invention and thus destroys part of the leverage which would otherwise be obtained as described above.

Figure 8:
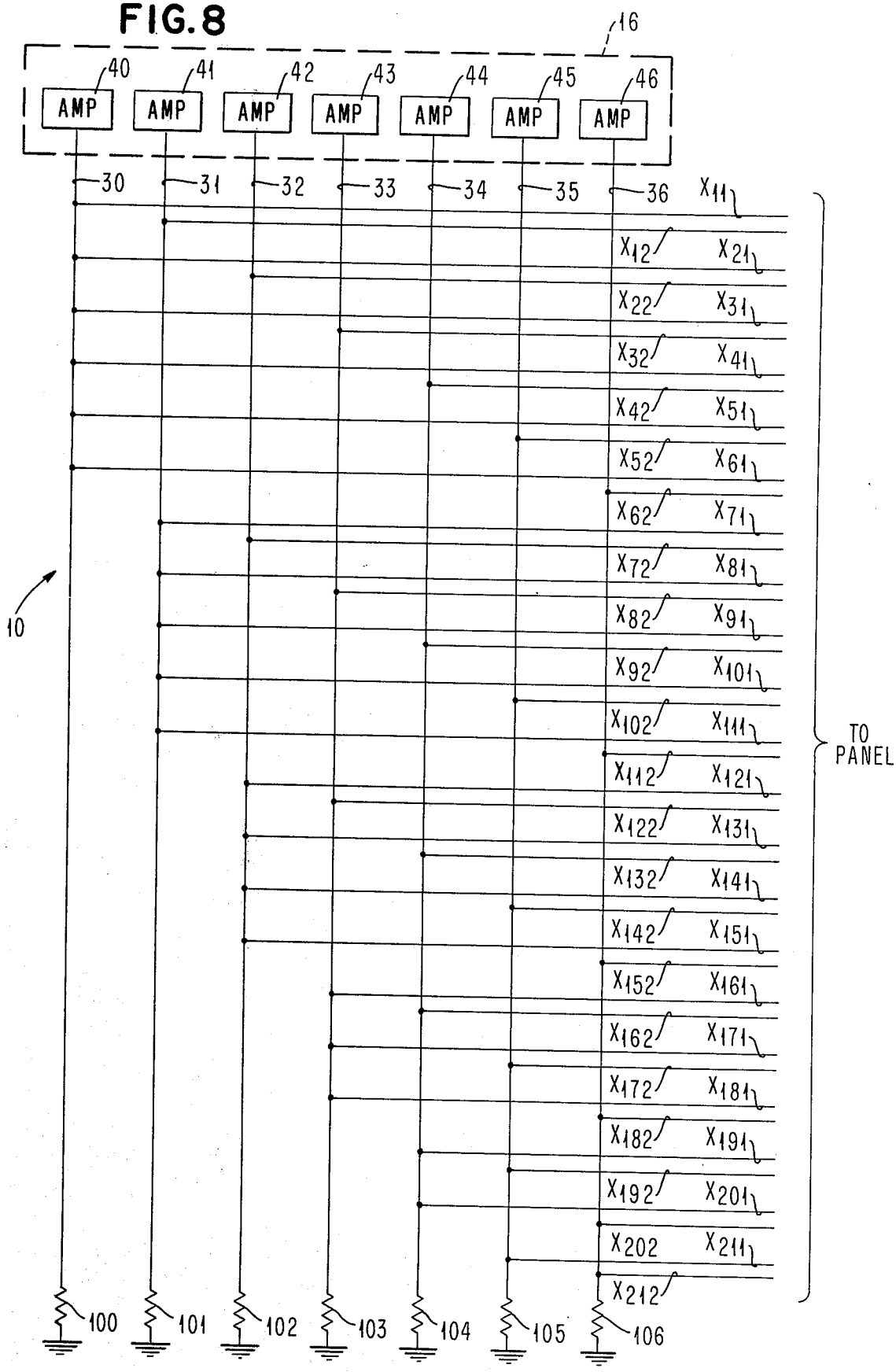
FIG. 8, akin to FIG. 1 of the incorporated patent, shows selection matrix connections for the twin X – twin Y panel.

FIG. 8 shows how the X selection lines of connection matrix 10 are connected to the X twin drive lines to provide a simplified selection curcuit in the manner of the invention of the incorporated patent. Reference numerals in FIG. 8 correspond to reference numerals in FIG. 1 of the incorporated patent. Seven selection lines, 30–36, are shown supplying 21 pairs of drive lines, and the selection of any two selection lines will enable a write or erase potential to be applied to a particular twin pair. For example, if selection lines 30 and 33 are raised, twin pair $X_{31}$ and $X_{32}$ are raised. If selection lines 31 and 33 are raised, twin pair $X_{81}$ and $X_{82}$ are raised. If selection lines 34 and 36 are raised, twin pair $X_{201}$ and $X_{202}$ are raised.

In a similar manner, the Y drive lines are connected by the Y selection matrix to the supply voltages. The Y circuit has not been shown since it is identical to the X circuit of FIG. 8. To fire any particular cell, the proper two X selection lines and the proper two Y selection lines must be raised to provide a write potential difference across the cell.

Thus, an improved display system has been provided to enable the use of simplified selection circuitry on large panels. The system can be used as described, but in the event that high resolution is desired, line triplets may be employed with the third line acting as a shield as taught by Lay in U.S. Pat. No. 3,666,981. While the invention has been particularly shown and described with reference to a preferred embodiment thereof, it will be understood by those skilled in the art that changes in form and details may be made without departing from the spirit and scope of the invention.

What is claimed is:

1. A display of the type having an envelope having two parallel flat walls and containing an ionizable medium therebetween, and light emitting cells formed at crossover points of sets of X and Y coordinate lines parallel with said walls, wherein the improvement comprises, pairs of conductors supported on said flat walls and extending positioned to define said coordinate lines, the two conductors of each pair being conductively isolated from each other, means connecting said conductors to be energized for write and erase operations in a pattern in which both conductors of a selected coordinate line are energized and only one of the two conductors of an unselected line is energized, said conductors of a pair being spaced apart on said walls to form a single cell at a point of crossover with conductors of the other coordinate set, said conductors of a pair being capacitively coupled such that the ionizable medium of a cell experiences the average voltage of the pair of conductors.

* * * * *